US006055751A

United States Patent [19]

Easthope

[11] Patent Number: 6,055,751

[45] Date of Patent: May 2, 2000

[54] APPARATUS AND METHOD FOR GRAPHICALLY MEMORIALIZING FISH

[76] Inventor: Joseph D. Easthope, 17711 SW. 18th St., Pembroke Pines, Fla. 33029

[21] Appl. No.: 09/149,162

[22] Filed: Sep. 5, 1998

[51] Int. Cl.[7] ..... G09F 3/00

[52] U.S. Cl. ..... 40/300; 40/586; 606/116; 606/117; D2/717

[58] Field of Search ..... 40/300, 586, 299.01; 206/575; 119/603, 604, 665; 2/1, 244, 246; D2/717, 741, 763, 765, 788, 809; 606/116, 117

[56] References Cited

U.S. PATENT DOCUMENTS

| | | |
|---|---|---|
| 1,742,649 | 1/1930 | Eastman . |
| 3,174,458 | 3/1965 | Levy et al. . |
| 3,545,405 | 12/1970 | Jefferts . |
| 4,392,236 | 7/1983 | Sandstrom et al. . |
| 4,713,315 | 12/1987 | Smith . |
| 4,750,490 | 6/1988 | Haw et al. . |
| 4,790,090 | 12/1988 | Sharber . |
| 4,920,670 | 5/1990 | Amick . |
| 5,324,940 | 6/1994 | Ekstrom . |

*Primary Examiner*—Terry Lee Melius
*Assistant Examiner*—James M Hewitt
*Attorney, Agent, or Firm*—Malin, Haley & DiMaggio, P.A.

[57] ABSTRACT

An apparatus and method for identifying, tagging, releasing and memorializing a specific fish with mass dissemination of information concerning said specific fish by producing a graphic image of the live fish on a sheet of material, such as cloth or fabric at the time of catch and obtaining factual data regarding the specific catch. The image and data are transferred to a medium such as a t-shirt for display for mass dissemination. A tag is placed on the fish with a telephone number to call if the fish is caught a second time. An apparatus according to the present invention may also comprise a kit including a suitable tag having information contained thereon for instructing a subsequent angler or other person capturing the fish to report details of the catch to a specific location, and further including a quantity of non-toxic colored liquid, an applicator for applying the liquid to one side of the actual live fish, and a sheet of material for receiving a graphic image of the live fish.

4 Claims, 3 Drawing Sheets

APPARATUS AND METHOD FOR GRAPHICALLY MEMORIALIZING FISH

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention relates generally to improving the ecology by returning safely live fish that are caught back to the ocean or sea using a program to encourage fish tagging, identifying and releasing and, more particularly to an apparatus and method for use by recreational and sport fishing anglers to tag and graphically memorialize a specific fish which has been caught and subsequently released, on a medium such as cloth shirts for mass dissemination of information concerning the actual fish caught.

2. Description of Related Art

Marine biologists and scientists have studied the activities of fish using various markers and tags for many years. The ability to account for the presence of a particular fish or group of fish in time and geographic area provides a basic tool for fishery resource management and conservation.

Fish tags or markers are commonly used to provide biologists and scientists with information relating to the migratory and/or transitory patterns of fish. For example, catch and release programs, wherein fish are initially caught, then tagged and released, provide large scale opportunities for obtaining information using fish tags since, upon recapture, additional information may be obtained and logged. An ideal fish tag has certain characteristics which include: being inexpensive and easily obtained; ease and security of attachment to a fish while not harming the fish; remaining unaltered for the life of the fish; having no effect on the fish's biological traits and behavior; having zero effect on the fish's status in the food chain; containing sufficient, clear and concise information which is easily detected and understood by untrained individuals.

A number of fish tags are known in the background art. For example, U.S. Pat. No. 1,742,649, issued to Eastman, discloses a band-type identification tag and method of banding fish for identification and conservation.

U.S. Pat. No. 4,790,090, issued to Sharber, discloses a fish tag having an invasive cellularly adhering point of attachment. Sharber teaches invasive anchoring of a fish tag by initial mechanical attachment and subsequent assimilation with the flesh of the fish through cellular adhesion, impregnation or ingrowth.

U.S. Pat. No. 4,920,670, issued to Amick, discloses a fish tag including a monofilament having a retention member on one end and a flexible indicia bearing tube positioned about the monofilament.

U.S. Pat. No. 3,545,405, issued to Jefferts, discloses an identifying tag which is capable of being implanted in a macro-organism, such as a fish. The tag disclosed by Jefferts comprises a small metallic body having on their surface thereof coded information in the form of a predetermined pattern which is imparted on the surface of the body by a high-energy heat source, such as a laser.

U.S. Pat. No. 4,713,315, issued to Smith, discloses a wire tag etching system, and U.S. Pat. No. 3,545,405, issued to Jefferts, discloses a system for marking wire with a plurality of spots in a predetermined pattern. Jefferts contemplates that the pattern is in binary form, which will enable the trained biologists to identify the tag and thereby determine the movements of the host fish.

U.S. Pat. No. 4,750,490, issued to Haw et al., discloses a method for tagging fish for identification including an identification tag which is shallowly implanted within transparent or semi-transparent tissues of respective specimens wherein markings on the tag remain visible. Haw et al. teaches a method which includes implanting a tag, releasing the tagged fish into a body of water, subsequently capturing the fish and optically reading the detectable markings through the transparent tissue. In an alternate embodiment, Haw et al. contemplates removing the tag from the fish and reading the detectable markings upon removal of the tag.

In order to make the public more aware of the "tag and release" ecology program to preserve fish, the desirability of mass dissemination of information memorializing the experience of catching a certain fish that has been tagged and released is recognized in the recreational and sport fishing fields. One option available to anglers wishing to memorialize a particular catch includes having the catch prepared for mounting by a taxidermist. However, since mounting of a catch requires that an angler seek out and pay for the services of a taxidermist, this form of memorialization provides a limited option and very limited dissemination. This also defeats safely returning the fish to the environment. Another option available to anglers wishing to memorialize a particular catch includes obtaining color certificates illustrating a photograph of the species of fish caught, and personalized with the details regarding the catch. Such certificates allow individuals to catch and release a prize fish while retaining the ability to memorialize each catch with a certificate. These certificates are available through various environmental organizations or governmental agencies, such as the Florida Game and Fresh Water Fish Commission. However, since many anglers are unaware of the availability of these certificates, use is limited. Accordingly, there exists a need for a simple, and cost effective apparatus and method for tagging and memorializing a specific catch which allows recreational and sport fishing anglers to quickly and easily tag and memorialize a catch on the spot, and, which allows for the specific fish to be released unharmed, and most importantly provides for mass dissemination of a graphic image of the specific fish caught with associated information regarding the catch location, the date, the time and size and weight information.

BRIEF SUMMARY OF THE INVENTION

An apparatus and method for identifying, tagging and safely releasing a specific fish and memorializing the catch of the specific fish by producing a graphic image of the live fish on a sheet of material, such as cloth or fabric and information regarding details of the specific catch of the fish including location, weight, time, date for mass production and mass dissemination. The apparatus and method also includes providing a tag on the specific fish that has a reference phone number to call if the fish is subsequently caught, with a reward, to identify the new location of catching the same fish twice.

The apparatus includes a fabric shirt having the graphic print of the actual fish displayed thereon and at a separate location on the same t-shirt, an information indicia display list printed on the shirt near the fish graphic image that gives specific information concerning the geographical location of the catch of the displayed fish on the shirt, the time and date of the catch, the type of fish, size, weight and any other pertinent details, such as bait or lure used. Multiple copies of the tshirt are made containing the reproduced image of the fish and the factual list of the catch information for mass dissemination of the information through t-shirts or other types of shirts to promote ecology.

According to the present invention, freshwater, saltwater, and fly fishing anglers (hereinafter "angler(s)") are provided with an apparatus and method to enable the angler to quickly and easily tag a fish with a fish tag which is attached to the fish such that the fish remains unharmed and otherwise unaffected, while the tag remains affixed for the life of the fish. Once tagged, the fish if caught again has useful information for those subsequently catching the tagged fish and reporting to a source identified on the tag. The information obtained provides useful information about the movements and habits of the tagged fish which relates to the same fish having mass information dissemination.

The apparatus according to the present invention also includes therefore a suitable fish tag having information contained thereon for instructing a subsequent angler or other person capturing the fish a second time to report details of the second catch to a specific telephone number or location and a possible reward.

The invention includes a method of memorializing a particular catch by production of a graphic image of the actual fish on a sheet of material for transfer to a large volume medium such as tshirts for mass dissemination. According to this aspect of the invention, a quantity of non-toxic ink is provided for use in producing a graphic reproduction of the live fish. The graphic reproduction is produced by first applying the ink directly to one side of the body of the live fish, then bringing the ink coated side body portion of the fish in contact with sheet material whereby an impression of the actual live fish is transferred to the sheet material. Accordingly, the angler is provided with a graphic image consisting of an impression of the actual fish, thereby accurately reproducing the fish image on the sheet of material. The invention thus provides the user with an accurate, full scale reproduction of the actual fish caught by the angler and subsequently released. The image on the sheet of material may then be computer enhanced for improved definition, and used to prepare a silk screen stencil for use in reproducing the image via a silk screen process for mass image dissemination on a cloth medium such as t-shirts. A display label on the t-shirts includes a list of specific information concerning the actual catch such as geographical location, date, time weight, length and other facts.

In the preferred embodiment, a tag according to the present invention includes a flexible strand of monofilament having a cross member integrally molded therewith and attached, at its midpoint thereto, and a length of tubing disposed about the monofilament. The cross member provides a structure for harmlessly securing the tag to a portion of a fish. The tubing includes an outer surface having indicia thereon, which indicia may include: a tag number; a telephone number; and written instructions for informing an angler who subsequently catches a tagged fish to remove the tag and report details regarding the catch to a specific source.

In an alternate embodiment the invention could include a kit or be in kit form for a particular angler to use by an individual on a boat. The kit would include a sheet of material suitable for receiving an ink or ink-like image of the fish, a quantity of nontoxic colored liquid, an applicator for applying the liquid to one or both sides of the actual live fish and an indicia tag that can be attached to a t-shirt or the form of which may be already applied to the t-shirt to include the information concerning the date, time and place of the catch of the fish and information concerning the fish such as weight, size and any other particulars. With the kit, the person as an individual on a boat, could thus catch the fish, apply the liquid to one or both sides of the fish, make a graphic print from the non-toxic colored liquid onto either a sheet material for further reproduction or, directly onto a t-shirt and supply the necessary other information on the same t-shirt. The fish would then be tagged with information concerning a call-up number if it is ever caught again for additional information concerning the fish, which is then safely released into the water.

Accordingly, it is an object of the present invention to provide an apparatus and method for tagging and graphically memorializing a specific captured fish prior to release for mass information dissemination.

Yet another object of the present invention is to provide a method for obtaining a graphic image of an actual, live fish without causing any harm to the fish, and allowing for the subsequent safe release of the fish to the ocean with the graphic picture of the fish being reproduced on a shirt with information concerning the actual catch for mass dissemination to increase public awareness for improving the environment.

And yet another object of this invention is to provide an apparatus such as a t-shirt that contains a graphic image of an actual live fish that was caught and released safely and that includes indicia information on the same t-shirt of the date and place of the catch and the specifics concerning the fish, which is mass produced and sold for mass dissemination, with the fish being tagged with information regarding any subsequent catch.

But yet another object of this invention is to provide a kit that contains apparatus for an individual fisherman to make a graphic imprint of the actual live fish that is caught onto a cloth medium and to provide on the cloth medium information concerning the catch of the fish and the fish while they are in the boat and also to apply a tag to the fish for subsequent callup if the fish is ever re-caught.

In accordance with these and other objects which will become apparent hereinafter, the instant invention will now be described with particular reference to the accompanying drawings.

DETAILED DESCRIPTION OF THE INVENTION

An apparatus and method for obtaining data on marine creatures, such as fish, by identifying, tagging, releasing and graphically memorializing the live catch which is graphically reproduced at the time the fish is caught for mass dissemination whereby a specific fish may be tagged and graphically reproduced for mass dissemination on a shirt by an angler in a manner which brings no harm to the fish and allows for the fish to be released, unharmed back into its natural habitat.

Figure 1A:
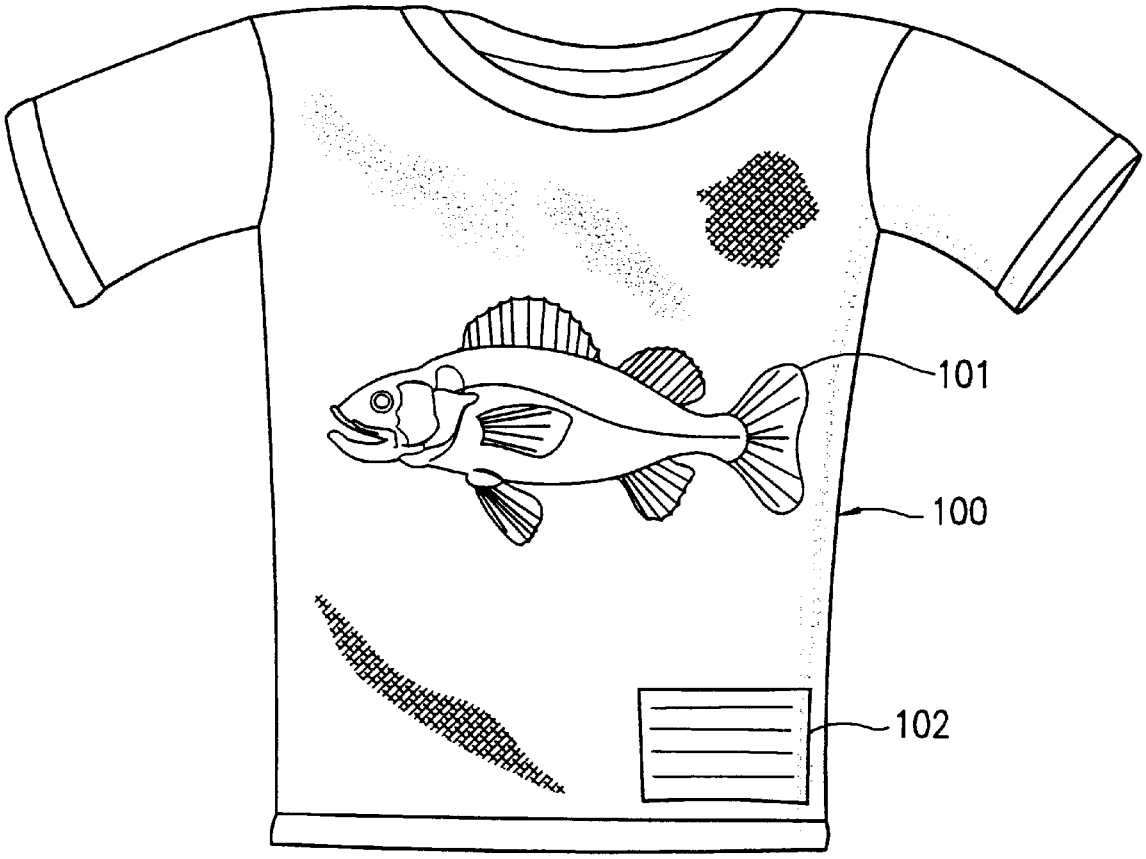
FIG. 1A shows a front elevational view of a device in accordance with the present invention.

Referring to FIG. 1A, a t-shirt 100 is shown which can be made of cotton or other suitable material that includes the actual graphic image 101 of a live fish that was caught, tagged and released. The t-shirt 100 also includes an indicia list that is permanently printed on the t-shirt that includes information of the date, the place, the size, the type of fish and any other relevant information to the specific fish 101 whose image has been transferred or reproduced onto the t-shirt so that there exists correlated information between the graphic fish 101 and the information display indicia 102. The t-shirt 100 graphic and list of information can be mass produced using known techniques for mass dissemination of reproducing the printed image described below.

The image on t-shirt 100 of the fish 101 was graphically reproduced from a specific caught live fish by placing a non-toxic colored ink or ink-like liquid on the fish body on one side and pressing the image of the fish onto a sheet of material that is suitable for receiving the graphic image and is suitable for transferred reproduction, either for computer enhancement or other known printing techniques.

The information that is ultimately displayed on listing label 102 is also recorded concerning the fish 101 and the information such as the date the fish was caught, the place, the size, the type of fish and any other relevant information may be placed on an indicia display list 102. Thus, the t-shirt 100 contains the graphic image of an actual fish that was caught, tagged and safely released and all the specific data and information regarding that specific fish is displayed permanently on the shirt 100. The shirt is then mass produced and mass dissemination concerning fish 101 is provided for.

Figure 8A:
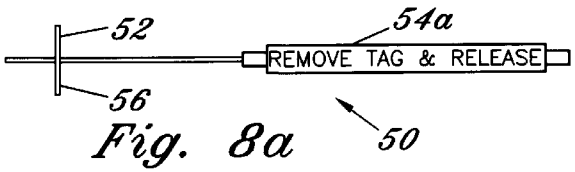
FIGS. 8*a* and 8*b* illustrate a fish tag in accordance with the present invention.
Figure 8B:
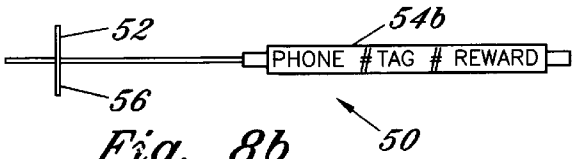

The actual live fish that was released has a permanent tag that is shown in FIGS. 8A and 8B that allows a second fisherman who catches the same fish again to call a number to relay information as to the second catch and get a reward so that the massly disseminated fish information can then be correlated to a second catch. The mass dissemination of a specific fish and all the information through t-shirts or other types of shirts or garments allows for a large number of the public to be privy to actual living fish that are in the ocean that have been successfully tagged and released safely and the specific data concerning that fish. This will greatly enhance public awareness and information of fish tag and release programs wherein the actual live fish is graphically presented to the mass public with the information concerning the fish displayed near the image.

Figure 1:
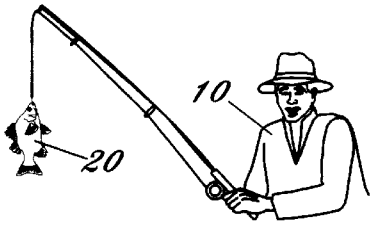
FIG. 1 illustrates an angler catching a fish.

With reference to FIGS. 1 through 16 a method according to the present invention is illustrated. FIG. 1 depicts an angler 10 catching a fish 20. It should be noted that the method employed by the angler to capture a live fish is irrelevant to the present invention. Accordingly, the fish may be captured using a fishing pole, a net, or any other suitable fish capturing apparatus.

Figure 2:
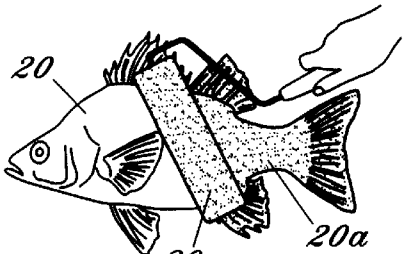
FIG. 2 illustrates application of a non-toxic ink to one side of the fish.
Figure 3:
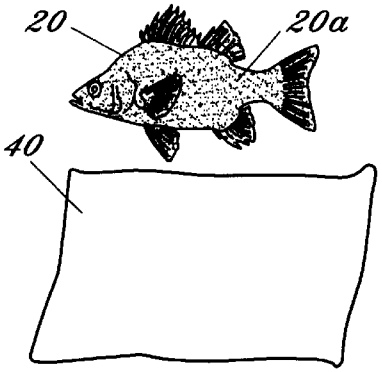
FIGS. 3 and 4 illustrate bringing the fish into contact with a sheet of material.
Figure 4:
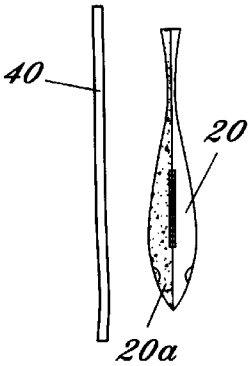
Figure 5:
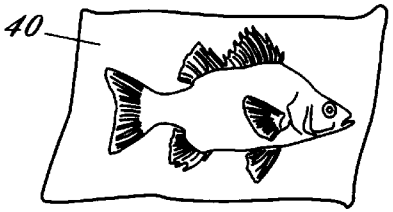
FIG. 5 illustrates a graphic reproduction of the fish on sheet material.

Next the angler applies a non-toxic ink to one side of the live fish 20, which one side is referenced as 20*a*, using a suitable applicator 30. In the preferred embodiment the non-toxic ink may comprise an edible food coloring or other non-toxic substance that will quickly dissolve when the fish is returned to water. Applicator 30 may comprise a hand-held brush, such as a paint brush or roller brush applicator as depicted in FIG. 2, however, any suitable applicator is considered within the scope of the present invention. Once a side of the fish has been coated with ink, an impression of the actual live fish is made by bringing fish 10 in contact with a sheet of material 40 as shown in FIGS. 3 and 4, resulting in the transfer of a graphical image of a live fish 20 on sheet 40 as best depicted in FIG. 5. Sheet 40 may comprise any suitable fabric or fabric like material that can retain an ink or ink like image for transfer to mass production onto a shirt. Therefore, sheet 40 may comprise a fabric sheet suitable for retaining the image for subsequent use in a silkscreen printing process. Accordingly, the graphic reproduction of the live fish may be initially obtained by the angler and subsequently commercially reproduced for sale and/or distribution in any suitable graphic image medium or form.

Figure 6:
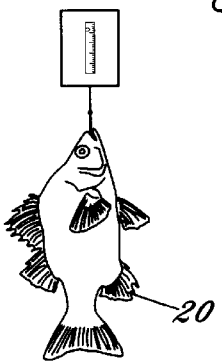
FIGS. 6 and 7 illustrate weighing and measuring of the fish.
Figure 7:
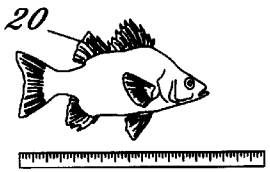

In addition, the invention contemplates recording data relating to fish 20, such as weight and length as best illustrated in FIG. 6 and 7. The data obtained is recorded for subsequent use on a shirt 100 as described in reference to FIG. 1A and, weight, length, and location is recorded by the angler and reported to an organizational body established by the inventor whereby the data may be stored for future reference.

The invention further provides a tag, referenced as 50, for attachment to fish 20 by the angler prior to release. Tag 50 comprises a fish tag having a first end 52 suitable for securing the tag to a portion of a fish and an alpha-numerica indica containing portion 54 for providing visually detectable and readable information and instructions. In the preferred embodiment, the first end 52 of tag 50 includes a flexible strand of monofilament having a cross member 56 integrally molded therewith and attached, at its mid-point thereto. Cross member 56 provides a structure for harmlessly securing the tag to a portion of a fish. Furthermore, tag 50, and particularly portion 54 thereof includes an outer surface having indicia thereon, which indicia may include: a tag number; a telephone number; and written instructions for informing an angler who subsequently catches a tagged fish to remove the tag and report details regarding the catch to a specific source. As best seen in FIG. 8*a*, a first side of tag portion 54, referenced as 54*a*, includes an instruction intended for an angler re-capturing the fish to "remove tag & release." As best seen in FIG. 8*b* a second side, referenced as 54*b*, includes a phone number, tag number, and an indication of an available award. In addition, an angler would preferably record other details relating to the catch such as the date and location where the catch occurred. Once tagged, useful information may be obtained by those subsequently catching the tagged fish and reported to a source identified on the tag. The information obtained provides useful information about the movement and habits of the tagged fish. Accordingly, the invention provides anglers with an apparatus and method to enable the angler to quickly and easily tag fish with a fish tag, which is attached to the fish such that the fish remains unharmed and otherwise unaffected, while the tag remains affixed for the life of the fish.

Figure 9:
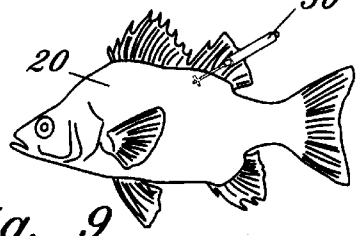
FIG. 9 illustrates application of a tag to the fish.
Figure 10:
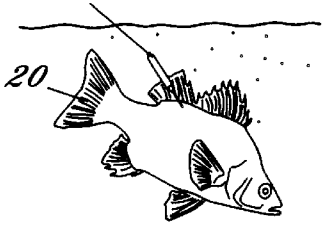
FIG. 10 illustrates release of the tagged fish.
Figure 11:
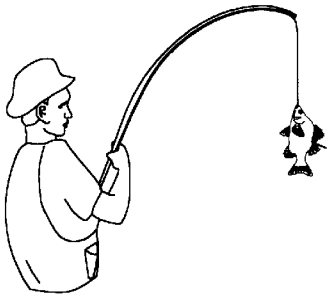
FIG. 11 illustrates re-capture of the tagged fish by a second angler.
Figure 12:
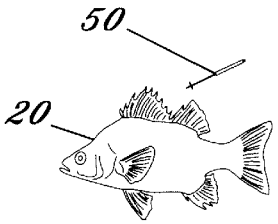
FIG. 12 illustrates removal of the tag.
Figure 13:
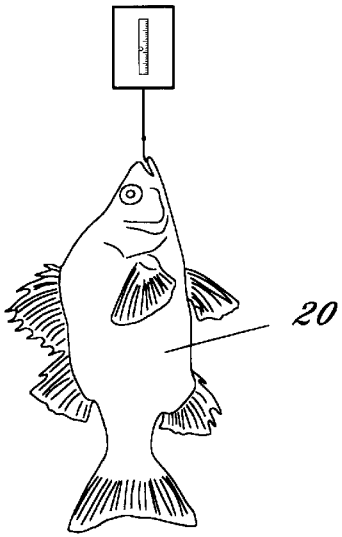
FIGS. 13 and 14 illustrate weighing and measuring of the re-captured fish.
Figure 14:
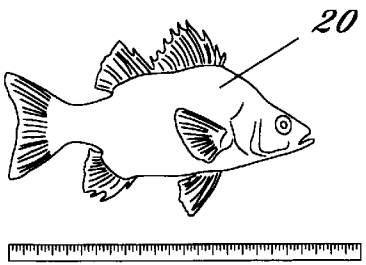
Figure 15:
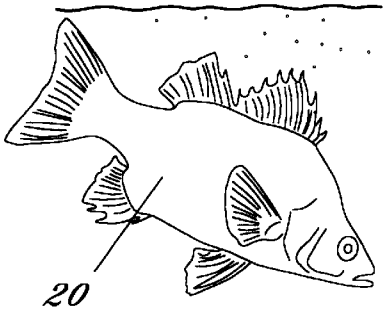
FIG. 15 illustrates re-release of the re-captured fish.
Figure 16:
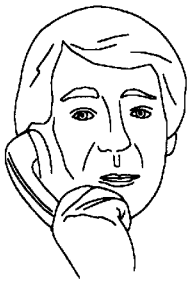
FIG. 16 illustrates the second angler following the instructions on the tag and reporting data regarding the re-captured fish.

FIG. 9 shows fish 20 with a tag implanted therein. FIG. 10 shows the fish 20 safely released into the ocean. FIGS. 11 and 12 show a second fisherman catching the same fish 20 and removing the tag in FIG. 12. In FIG. 13 the fish is weighed, in FIG. 14 the fish 20 is measured and in FIG. 15 the fish is again released. FIG. 16 shows the person who caught the fish for the second time calling preferably an 800 number to provide the information on the second catch of the fish. The fish could also be released with yet another tag for a third possible catch.

The purpose of the whole program is to encourage the public to gain more information concerning the importance of its tag and release program to safely protect fish.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for use by an angler for tagging, identifying, releasing and graphically memorializing a specific live fish for mass information dissemination, said apparatus comprising:

a fish tag, said tag including means for securely retaining said tag to the fish, said tag further including a portion thereof containing alpha-numeric indicia thereon;

non-toxic colored liquid capable of transferring a graphic image;

an applicator for applying said liquid to one side of the fish;

a sheet of material for receiving a graphic image of a specific fish from said colored liquid disposed on the fish by direct contact with the fish;

means for applying said graphic fish image to a medium for mass dissemination of information; and an indicia list attached to said medium containing specific factual information regarding the fish and identification of the fish and graphically displayed for mass dissemination of information;

a plurality of shirts having reproductions of said graphic fish image and said indicia list for widespread dissemination; and whereby, upon catching the fish, the angler obtains a graphic image of the fish by applying a coating of said liquid to one side of the fish using said applicator and creating said graphic fish image by bringing said sheet of material in contact with a coated side of the fish, whereafter the angler affixes said tag to the fish using said means for securely retaining said tag and releases the fish.

2. An apparatus for use by an angler for tagging and graphically memorializing live fish according to claim 1, wherein said non-toxic colored liquid comprises food coloring.

3. An apparatus for use by an angler for tagging and graphically memorializing live fish according to claim 1, wherein said applicator comprises a brush.

4. An apparatus for use by an angler for tagging and graphically memorializing live fish according to claim 3, wherein said brush comprises a roller brush.

* * * * *